US005613896A

United States Patent [19]

Haus et al.

[11] Patent Number: 5,613,896

[45] Date of Patent: Mar. 25, 1997

[54] AUTOMATIC BOWLING BALL RESURFACING MACHINE

[76] Inventors: Bruce A. Haus, 29500 Bloom St. Box 398, Chisago City, Minn. 55013; Andrew A. Kolkind, Rte. 3, Box 370, Isanti, Minn. 55040

[21] Appl. No.: 497,559

[22] Filed: Jun. 30, 1995

[51] Int. Cl.[6] ..... B24B 11/10

[52] U.S. Cl. ..... 451/50; 451/112; 451/268

[58] Field of Search ..... 451/50, 112, 262, 451/268, 450, 548

[56] References Cited

U.S. PATENT DOCUMENTS

| | | | |
|---|---|---|---|
| 2,405,344 | 8/1946 | Cloutier | 451/50 |
| 3,024,578 | 3/1962 | Mushkin | 451/50 |
| 3,133,393 | 5/1964 | Chapman | 451/50 |
| 3,167,884 | 2/1965 | Thompson | 451/50 |

FOREIGN PATENT DOCUMENTS

| | | | |
|---|---|---|---|
| 0037294 | 3/1977 | Japan | 451/50 |
| 2009859 | 1/1987 | Japan | 451/50 |
| 3121759 | 5/1991 | Japan | 451/50 |
| 7412573 | 6/1975 | Netherlands | 451/50 |
| 1214393 | 2/1986 | U.S.S.R. | 451/389 |
| 1393601 | 5/1988 | U.S.S.R. | 451/50 |

*Primary Examiner*—Robert A. Rose
*Attorney, Agent, or Firm*—Jacobson & Johnson

[57] ABSTRACT

A machine for refinishing the surface of a bowling to improve the roundness of the bowling ball with the machine including individual bowling ball resurfacing units each having a cone-shaped cup resiliently supported on the bowling ball resurfacing unit with the cone-shaped abrading cups having an annular abrading region located on the periphery of cone-shaped abrading cup so that when the cone-shaped abrading cups are rotated the abrading region engages a surface on the bowling ball to simultaneously rotate and abrade the surface of the bowling ball to bring the bowling ball into round.

10 Claims, 5 Drawing Sheets

AUTOMATIC BOWLING BALL RESURFACING MACHINE

FIELD OF THE INVENTION

This invention relates generally to machines for refinishing a surface on a bowling ball and, more specifically, to a machine for automatically resurfacing a bowling ball to bring the bowling ball back into round.

BACKGROUND OF THE INVENTION

One of the problems that occurs with bowling balls is that when the ball is released it does not immediately roll along the lane but slips or spins along the lane. This spin of the ball along the lane causes the ball to receive excessive wear on the portion of the ball that slips along the lane. This repeated slipping causes the ball to lose its sphericity. Typically, an elongated groove or track is worn in the surface of the ball as the ball is repeatedly released with the same spin. This is referred to as the ball becoming out-of-round. Simply resurfacing of the ball can smoothen the region around the groove or track but the basic out-of-roundness of the ball remains since the recess in the surface of the ball produced by the groove or mack remains in the ball unless the entire diameter of the ball is reduced to the diameter of the ball at the low spot. Typically, a ball may be out-of-round and have a low spot that is in excess of ten thousandths of an inch from the normal perfect spherical shape of the ball. Two approaches are used to minimized the effect of the track worn in the ball. One approach is to simply sand or smoothen the surface so that the edges of the groove or track are blended into the surface of the ball however, this approach does not bring the ball back to its original spherical shape. The other approach is to recut the ball to a smaller diameter that has the shape of a perfect sphere.

The concept of bowling-ball resurfacing machines for smoothing the surfaces of the ball as well as recutting the surface of the ball are old in the art. However, one of the difficulties with prior art machines and particularly those that recut the ball is that not only are the machines costly, the machines oftentimes require precise alignment of both the ball and the cutting tool in order to bring an out-of-round ball back into round.

The present invention provides an improvement to ball-resurfacing machines in which no alignment or adjustment of the forces on the ball is necessary to allow the resurfacing operation to be completed by an unskilled operator in a few minutes with the ball restored to its original perfect spherical shape through the resurfacing action of the present invention.

DESCRIPTION OF THE PRIOR ART

U.S. Pat. No. 4,856,231 shows a machine for grinding large balls in which a motor rotates the ball against a dish-shaped grinding tool located on top of the ball.

U.S. Pat. No. 4,517,770 shows a gemstone polishing machine for polishing the individual facets of a gemstone.

U.S. Pat. No. 3.971,164 shows a bowling ball resurfacing machine wherein a series of rollers support the bowling ball and a sanding disk is brought laterally against the ball. The ball is rolled manually to polish its surface.

U.S. Pat. No. 3,191,468 shows a ball-surfacing machine having a tool bit 23 for cutting the surface of the ball as it is supported on the lathe.

U.S. Pat. No. 3,106,133 shows a surface-finish machine for bowling balls for removing material extending from plugged holes with a cutting tool.

U.S. Pat. No. 3,714,703 shows a ball held in a chuck by a vacuum force while a cutting tool mounted on the machine moves in the vertical plane at a predetermined distance from an axis passing through the center of the ball. Rotating the ball causes the cutter to remove excess material and bring the ball back into round. This embodiment requires precise alignment of the ball and the cutter.

U.S. Pat. No. 3,133,383 shows a ball grinding and lapping machine where one of the grinding cups is mounted to move horizontally in and out to increase the pressure on the ball. Two of the cups rotate and the third oscillates back and forth.

U.S. Pat. No. 3,024,578 shows a bowling ball device using two heads one for holding the ball and the other being idle. In order to uniformly grind the ball the pressure on each head is continually varied by an automatic control.

U.S. Pat. No. 3,961,448 shows a polishing device that uses concave hemispherical surfaces to polish the surface of a ball.

French patent 2688730 shows an abrasive for use in manufacturing automobile bearings.

Japanese patent 62-9859 shows a ball receiving bed for holding a ball and grinding the ball with the rotary shafts driven inward and outward by hydraulic cylinders

BRIEF SUMMARY OF THE INVENTION

Briefly, the invention comprises a machine for automatically refinishing the surface of a bowling ball to improve the roundness of the bowling ball with the machine including individual bowling ball resurfacing units that are pivotally mounted at an angle to the horizontal to support the bowling ball therein and to use the weight of the the bowling ball to control a portion of the radial forces on the bowling ball. Each of the resurfacing unit have a cone-shaped abrading cup rotatably supported by the bowling ball resurfacing unit with the cone-shaped abrading cups having an annular abrading region located on the periphery of cone-shaped abrading cup so that when the cone-shaped abrading cups are rotated about their central axis the annular abrading region abrades the surface on the bowling ball to bring the ball back into round with the coaction of the rotating abrading cups causes the ball to simultaneously rotate the ball so that the surfaces needing abrading are pulled into the cone-shaped abrading cup to automatically abrade away the high spots on the surface of the bowling ball and bring the bowling ball into round.

DESCRIPTION OF THE PREFERRED EMBODIMENT

Figure 1:
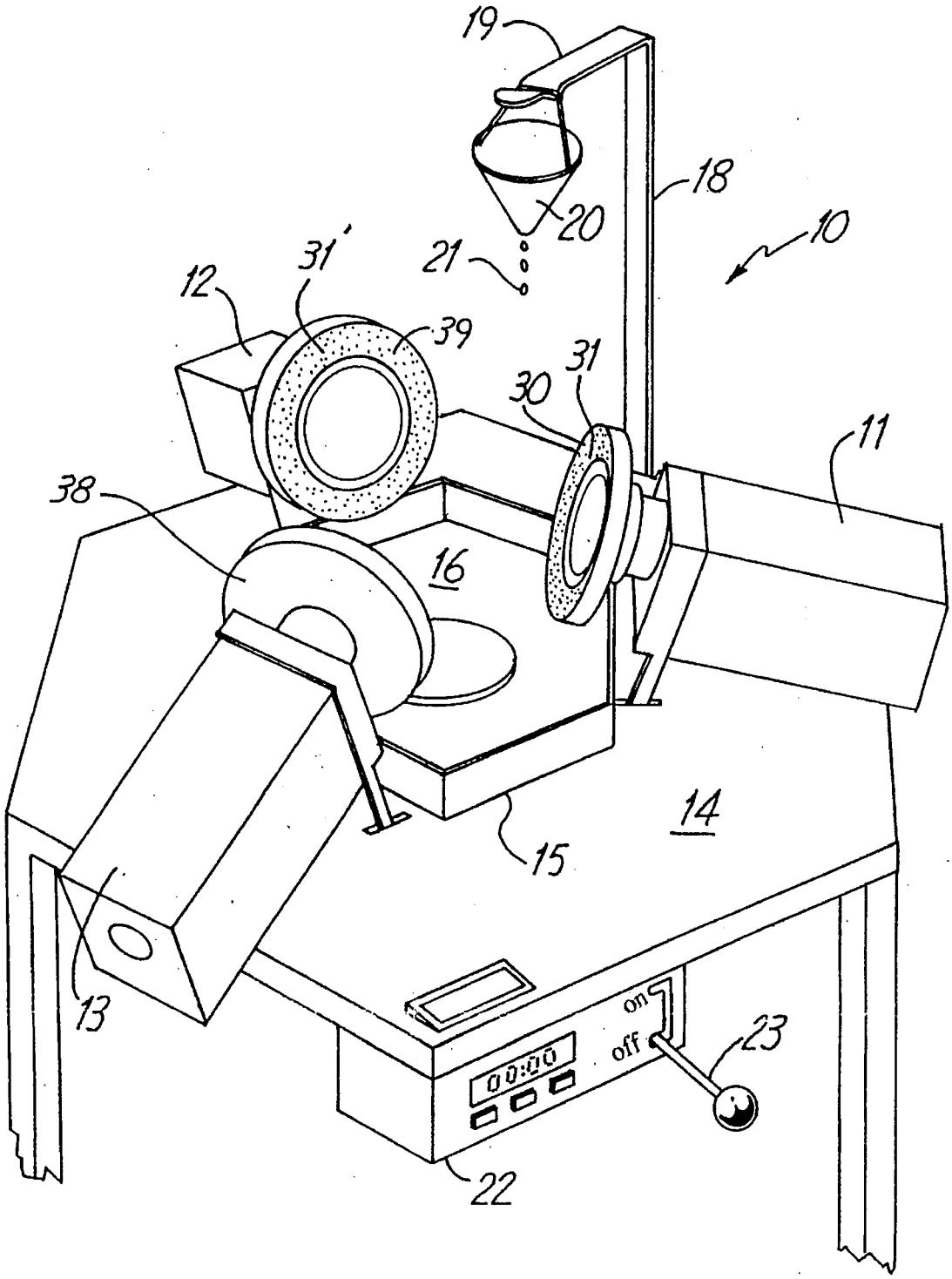
FIG. 1 shows a perspective view of my bowling-ball resurfacing device.

FIG. 1 reference numeral 10 generally identifies my bowling ball resurfacing machine comprising three resurfacing units 11, 12 and 13 which are equally spaced about a platform 14. Platform 14 includes a control console 22 with a control lever 23 for starting and stopping the resurfacing units. An L-shaped bracket 18 mounts on platform 14 with one end of bracket 18 having an extension 19 supporting a fluid lubricator 20 suspended therefrom. Fluid lubricator 20 comprises a funnel shaped container with a large open top on one end and a small drip spout at the other end. When a ball resurfacing lubricating liquid such as water or the like is placed in the large open end of lubricator 20 the water drips from a small opening in the bottom of the lubricator onto the bowling ball which is supported between and by resurfacing units 11, 12 and 13. A collection area 16 permits collection of the used lubricating fluid and abraded particles.

Resurfacing units 11, 12 and 13 are pivotally and resiliently supported by platform 14 so that a ball can be placed between the resurfacing units and supported by the resurfacing units during the resurfacing operation.

Figure 2:
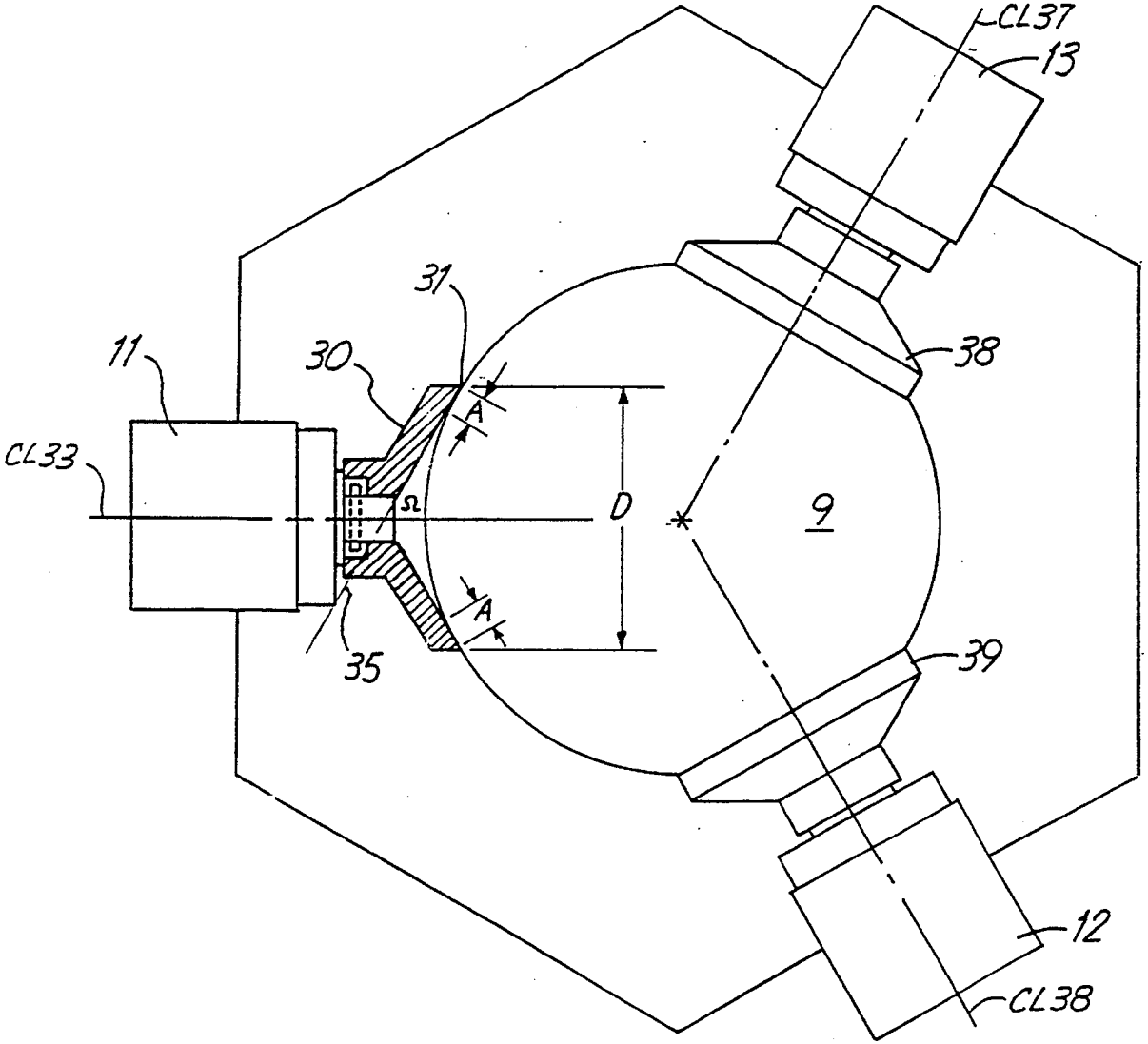
FIG. 2 shows a partial top sectional view of my bowling-ball resurfacing device with a ball therein.

FIG. 2 shows a bowling ball 9 positioned between the three resurfacing units 11, 12 and 13 and supported by cone-shaped abrading cups 30, 38 and 39. The resurfacing units are orientated so center lines 33, 37 and 38 of resurfacing units 11, 12 and 13 intersect at a common point with each of the center lines located at approximately 120° angles to each other when three units are used. While more or less resurfacing units can be used to resurface a ball, three resurfacing units coact to both support and rotate the ball during the resurfacing operation. Each of the resurfacing units 11, 12 and 13 are identical, so only one will be described herein. The resurfacing unit 11 has a rotating cone-shaped abrading cup 30 of diameter D having an annular abrading area 31 designated by A. The cone angle Ω which is formed by the intersection of surface line 35 and centerline 33 is sufficiently large so that only the annular abrading area 31 of the cone-shaped abrading cup engages the ball for resurfacing. A variable speed electric motor is located in each of resurfacing units 11, 12 and 13. Because the motors of the resurfacing units are electrically powered and separate from each other the rotational speed of the cone-shaped cups of each of the resurfacing motors are independent of each other. FIG. 1 shows the cone-shaped abrading cup 30 with an annular abrading region 31 and the cone-shaped abrading cup 39 with an abrading region 31.

Figure 3:
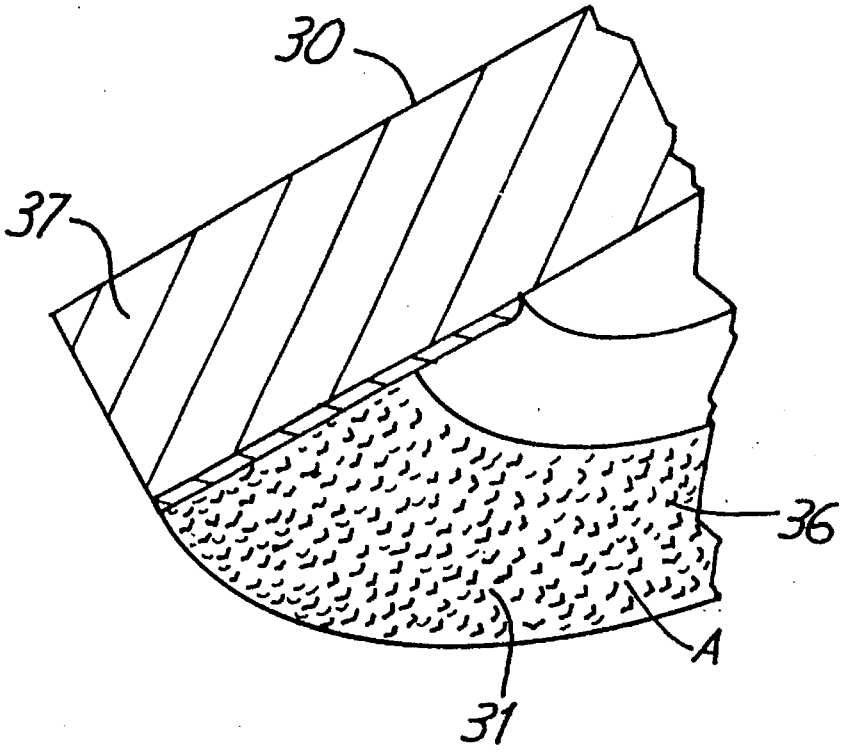
FIG. 3 shows an enlarged portion of the cone shaped abrading cup in my bowling-ball resurfacing device.

FIG. 3 shows a large sectional portion of cone-shaped abrading cup 30 showing the area A which is designated by reference numeral 31. In the preferred embodiment the cone-shaped abrading cup 30 is made of aluminum 37. Located on the peripheral area of the cone-shaped abrading cup are industrial grade diamonds which are held onto the aluminum by electroless nickel. The purpose in use of electroless nickel is that it does not adhere to the diamonds but forms a layer around a portion of the irregular diamonds to form a mechanical lock with a portion of the exterior surfaces of the diamonds and allows the other portions of the diamonds to be exposed to permit abrading.

Figure 4:
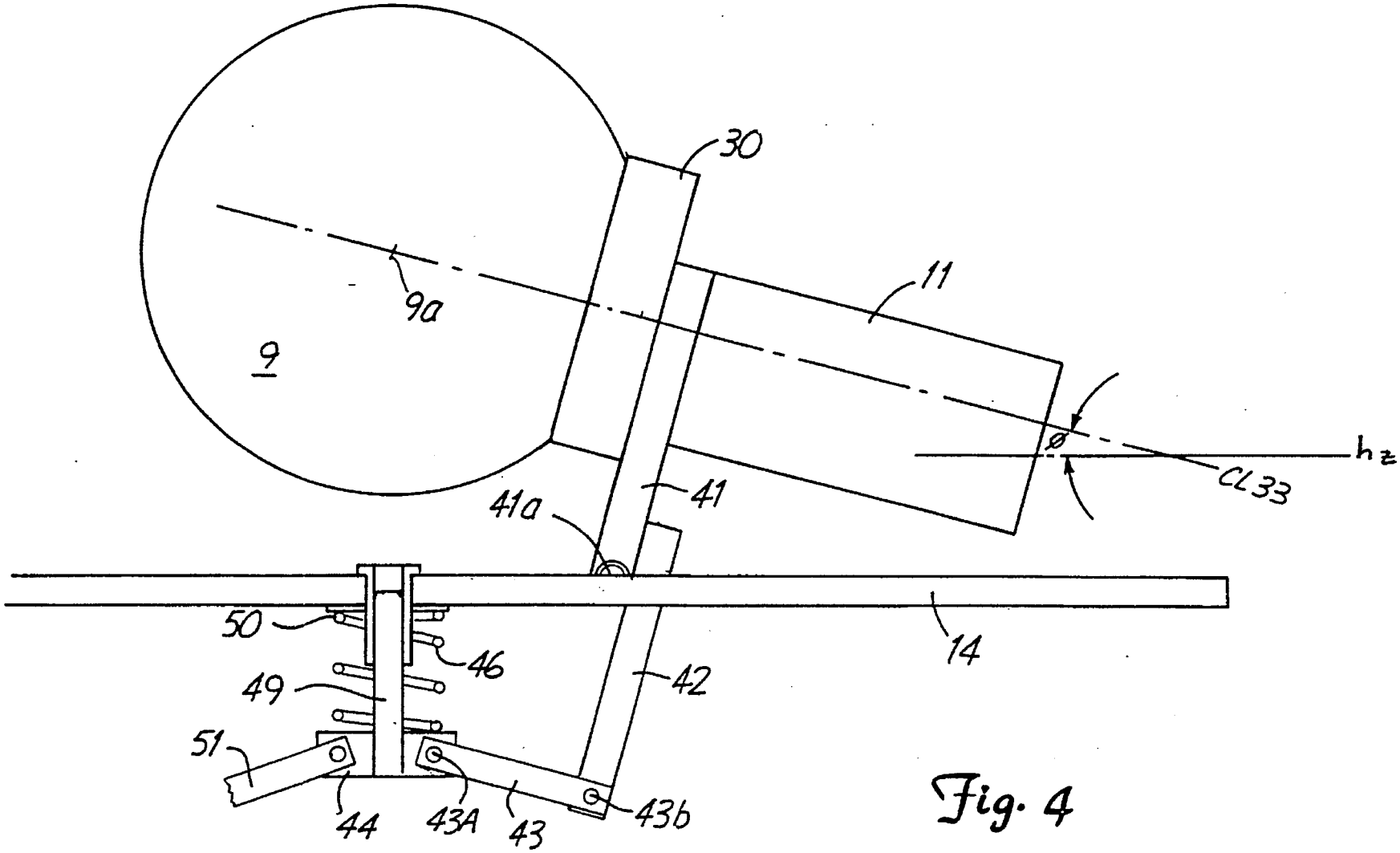
FIG. 4 shows one of the resilient support mechanisms for supporting the ball and holding the cone shaped abrading cups in uniform pressure contact with the bowling ball during the resurfacing of the bowling ball.
Figure 5:
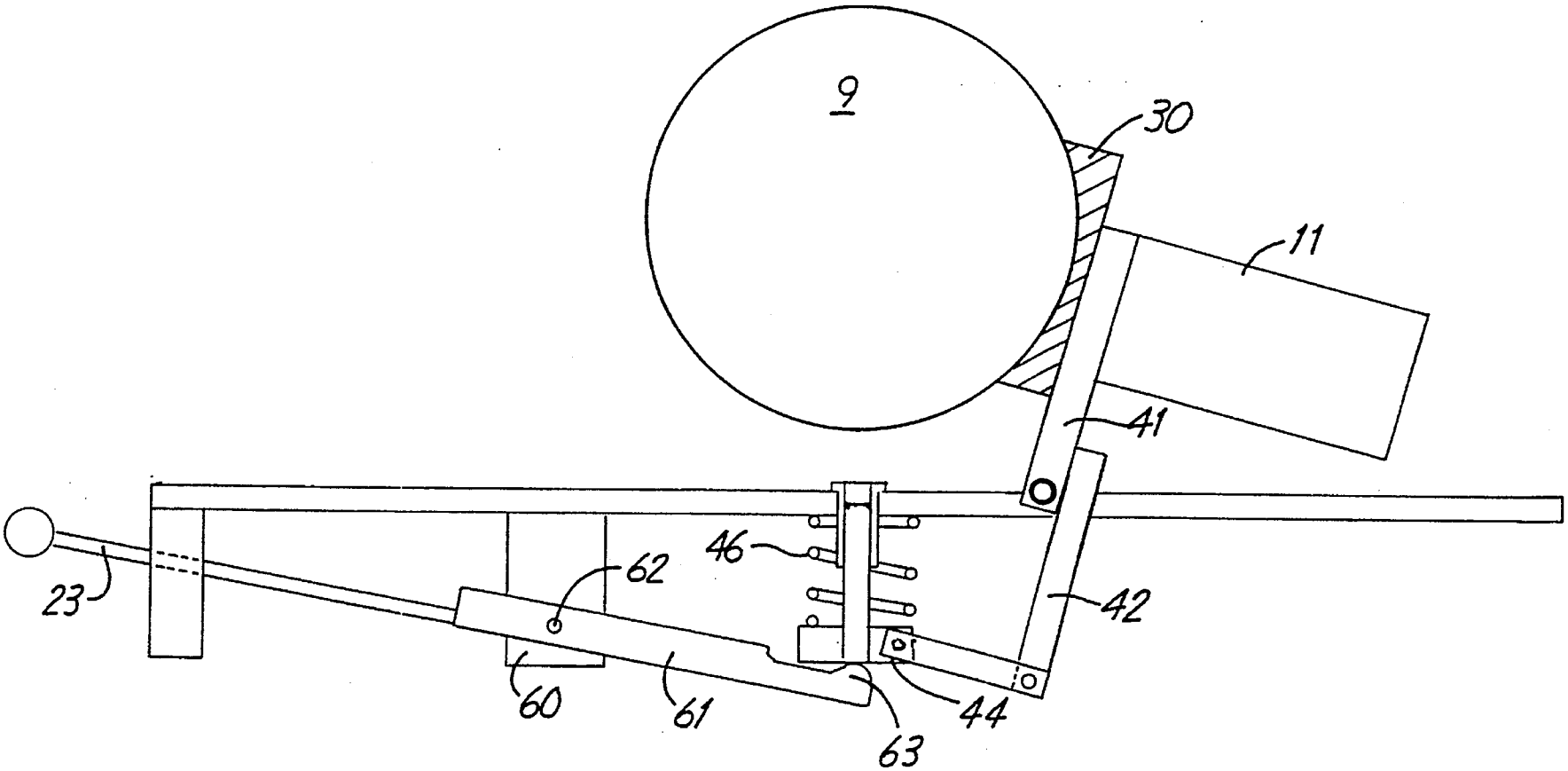

FIG. 4 shows a resilient support mechanism for resurfacing unit 11. As all three of the units have identical resilient support mechanism only one will be described herein. FIG. 4 shows platform 14 with resurfacing unit 11 attached to a radially extending member 41 which is pivotally supported on platform 14 through a beating 41*a*. That is, member 41, which supports resurfacing unit 11, can pivot about bearing 41*a* to allow rearward displacement of resurfacing unit 11 to allow ball 9 to be placed between the three resurfacing units 11, 12 and 13 as shown in FIG. 2. FIG. 4 illustrates that the bowling ball center is in alignment with the axis of rotation 33 which extends through the geometric center of cone-shaped abrading 30. Similarly, the axis of rotation of the cone-shaped abrading cups of units 12 and 13 are also located in alignment with the geometric center of the bowling ball. The annular region 31 of cone cone-shaped abrading cup 30 and the similar annular regions on cone-shaped abrading cups 38 and 39 form a mating surface for engaging the exterior surface of the bowling ball. Because the cone-shaped abrading cups are spaced about the ball they coact to both center and support bowling ball 9 there between.

A rigid member 42 fixedly connects to rigid member 41 so that member 41 and 42 function as a single member. Member 42 extends through an opening in platform 14 with one end of member 42 pivotally connected to one end of a rigid link 43 through a pivot pin. Similarly, the other end of rigid link 43 connects to a central member 44 through a pivot pin 43*a*. Connected to member 44 is a cylindrical pin 49 that can slide vertically up and down within a sleeve 50 which is fastened to platform 14. A compression spring 46 extends between the underside of platform 14 and member 44 to provide a force that pushes downward on member 44. The link member 43 and 42 which are connected to member 44 provide an upward force that compresses spring 46. The force of spring 46 provides a resilient restoring to provides a pivoting force about bearing 41*a* which pushes cone 30*a* toward ball 9. Each of the other two units have links that similarly connect to member 44 so that the combination of three units coacts act to support and hold the ball in a centered position. FIG. 4 shows a cutaway view of a link 51 for another resurfacing unit.

FIG. 4 shows that the axis 33 of resurfacing unit 11 is located at an angle θ with respect to the horizontal plane $h_2$. While the angle θ is dependent on various factors, we have found that a minimum angle of about 30 degrees with respect to the horizontal is sufficient to create the necessary force between the ball and the resurfacing units so that one can automatically resurface the bowling ball. That is, the bowling ball is vertically supported by the three units and the rotation of the the three units causes the ball to rotate randomly which results in the entire surface of the ball being resurfaced. FIG. 2 illustrates how a ball 9 is held in a centered position within the three resurfacing units 11, 12, and 13.

In operation of the invention one pushes rearward on one of the resurfacing units which compresses spring 46 to allow placement of bowling ball 9 between the cone-shaped abrading cup 30, 38 and 39. Next one releases the resurfacing unit allowing the resiliency of spring 46 to push downward on member 44 which provides a pivoting force to member 41 to push cone-shaped cups 30,38 and 39 into pressure contact with bowling ball 9. Water is poured into container 20 and allowed to drip onto the surface of bowling ball 9. To start the device, the operator turns on the motors of each of the resurfacing units with lever 23 (FIG. 1 ) while allowing the force of member 46 to support ball 9 between the three cone-shaped abrading members 30, 38 and 39.

The individual resurfacing units 11, 12 and 13, which are independent of each other, are rotated at a speed dependent on the type of finishing required. A typical rotational speed can be 110 rpm with lower rpms used for rough finishing and higher rpms used for smoother finishing. Typically, a rough finish can be obtained with 80 rpm and a smoother finish can be obtained with rpms of 250 or above. Using three units and a conventional bowling ball that is out-of-round by 0.010 inches the present invention can bring the ball back into round within approximately ten minutes.

A feature of the present invention is that no alignment of the ball within the ball resurfacing units is required since the resiliency of spring 46 pushes each of the cone-shaped cups into pressure contact with the bowling ball 9 and in doing so centers the ball 9 therebetween. A further feature of the invention is that the motion imparted to ball because of the rotation of the cup produces lateral forces that revolve and rotate the ball bringing fresh surfaces of the ball into contact with the abrading regions of the resurfacing unit. That is the bowling ball experiences changing rotational forces resulting in rotation of the ball during the abrading process. As a result the surfaces of the ball needing abrading are brought into round without the aid of special external forces to rotate the ball during the rounding process.

We claim:

1. A machine for automatically refinishing the surface of a bowling ball to improve the roundness of the bowling ball having a predetermined weight comprising:

a table;

a first bowling ball resurfacing unit pivotally mounted with respect to said table, said first bowling ball resurfacing unit having a first member for pivoting said first bowling ball resurfacing unit;

a first cone-shaped cup located on said bowling ball resurfacing unit, said first cone-shaped cup postionable in a first partial ball supporting position on a portion of the bowling ball, said first cone-shaped cup having a first central axis with said first cone-shaped cup rotatable about said first central axis, said first central axis forming a first acute angle to a horizontal plane; and a first annular abrading region located on said first cone-shaped cup so that when said first cone-shaped cup is rotated about said first central axis said first abrading region engages a surface on the bowling ball to simultaneously rotate and abrade the surface of the bowling ball to bring the bowling ball into round;

a second bowling ball resurfacing unit pivotally mounted with respect to said table said second bowling ball resurfacing unit having a second member for pivoting said second bowling ball resurfacing unit;

a second cone-shaped cup located on said bowling ball resurfacing unit, said second cone-shaped cup postionable in a second partial ball supporting position on a portion of the bowling ball, said second cone-shaped cup having a second central axis with said second cone-shaped cup rotatable about said second central axis, said second central axis forming a second acute angle to the horizontal plane;

a second annular abrading region located on said second cone-shaped cup so that when said second cone-shaped cup is rotated about said second central axis said second abrading region engages a surface on the bowling ball to simultaneously rotate and abrade the surface of the bowling ball to bring the bowling ball into round;

a third bowling ball resurfacing unit pivotally mounted with respect to said table said third bowling ball resurfacing unit having a third member for pivoting said third bowling ball resurfacing unit;

a third cone-shaped cup located on said bowling ball resurfacing unit, said third cone-shaped cup postionable in a third partial ball supporting position on a portion of the bowling ball, said third cone-shaped cup having a third central axis with said third cone-shaped cup rotatable about said third central axis, said third central axis forming a third acute angle to the horizontal plane;

a third annular abrading region located on said third cone-shaped cup so that when said third cone-shaped cup is rotated about said third central axis with said third abrading region engages a surface on the bowling ball to simultaneously rotate and abrade the surface of the bowling ball to bring the bowling ball into round, said first central axis, said second central axis and said third central axis located at a minimum angle to the horizontal of about 30 degrees with respect to each of said three cone shaped cups with the three cups coacting to support and abrade the surface of the bowling ball as the cone shaped cups are rotated about their respective central axis;

a spring mounted on said table;

a central member said central member connected to said spring and to each of said members for pivoting said bowling ball resurfacing units; said central member coacting with said spring to so that when a bowling ball is centrally placed with respect to each of said cone shaped cups the weight of the bowling ball is resiliently supported by each of said bowling ball resurfacing units to maintain constant pressure contact between each of the cone-shaped cups and the surface of the bowling ball to enable the bowling ball to be resurfaced as each of the cups are rotated about their respective central axis with the rotation of the cups imparting lateral forces that rotate revolve and rotate the bowling ball without the aid of external forces to rotate the ball during the resurfacing process.

2. The machine of claim 1 wherein the three bowling ball resurfacing units are located at equally spaced intervals for supporting the bowling ball therebetween and said table includes a sleeve and said central member includes a pin for sliding in said sleeve to enable said cylindrical member to move with respect to said table.

3. The machine of claim 2 including a fluid lubricator for lubricating the surface of the bowling ball supported by said cone-shaped cup.

4. The machine of claim 3 wherein the abrading region comprises an annular region on said cone-shaped cup with industrial grade diamonds secured to said cone-shaped cup by an electroless nickel plate.

5. The machine of claim 4 wherein the abrading region on the cone-shaped cup has a diameter that is less than the diameter of a bowling ball to be resurfaced.

6. The machine of claim 5 wherein the rotation of each of the resurfacing units are independent of each other.

7. A machine for automatically refinishing the surface of a bowling ball to improve the roundness of the bowling ball having a predetermined weight comprising:

a table;

at least three resurfacing units, each of said resurfacing units having an abrading surface with each of said resurfacing units pivotally mounted to said table, each of said resurfacing units pivotal in a vertical plane, said resurfacing units spaced equal distance from an adjacent resurfacing unit and each having a central axis which is located at sufficient angle from the horizontal to provide vertical support for the bowling ball and to utilized the weight of the bowling ball to help maintain pressure contact between a surface of the ball to be refinished and to each of the resurfacing units;

a spring mounted to said table;

a central member connected to said spring and each of said resurfacing units so that the weight of the bowling ball is exerted against said spring through each of said resurfacing units to thereby support said bowling between said resurfacing units and means for rotating said abrading surfaces to enable the resurfacing units to both support and abrade the bowling ball to bring the bowling ball into round.

8. The machine of claim 1 wherein each of the annular abrading regions include a base member having a surface;

abrading material particles located on said surface, said abrading material particles mechanically secured to said base member by a layer of material that adheres to said base member but not to said abrading material particles, said layer of material extending over and encapsulating portions of the abrading material particles while permitting other portions of the abrading material particles to remain free of the layer of material to permit the other portions of abrading material particles free of the layer of material to be used to abrade a surface.

9. The member of claim 8 wherein the abrading material particles are diamond particles and the layer of material is electroless nickel.

10. The machine of claim 2 including a control lever mounted on said table, said control lever operable for raising or lowering the central member to pivot the resurfacing units into or out of engagement with the bowling ball located between said resurfacing units.

* * * * *